US005513591A

United States Patent [19]

Quartarone et al.

[11] Patent Number: 5,513,591

[45] Date of Patent: May 7, 1996

[54] UNDERWATER BODY AND INTAKE SCOOP

[75] Inventors: James R. Quartarone, Newport; Anthony N. Corvelli, Bristol, both of R.I.

[73] Assignee: The United States of America as represented by the Secretary of the Navy, Washington, D.C.

[21] Appl. No.: 320,627

[22] Filed: Oct. 7, 1994

[51] Int. Cl.[6] ..... B63B 17/00

[52] U.S. Cl. ..... 114/173; 114/337; 114/312

[58] Field of Search ..... 244/538, 199; 114/312, 337, 173, 20.1, 20.2; 440/66, 67, 38, 46, 47; 180/68.3

[56] References Cited

U.S. PATENT DOCUMENTS

| | | | |
|---|---|---|---|
| 3,182,623 | 5/1965 | Lehmann | 114/337 |
| 3,942,463 | 3/1976 | Johnson, Jr. et al. | 440/47 |
| 4,174,083 | 11/1979 | Mohn | 244/53 B |
| 4,378,097 | 3/1983 | Ferguson et al. | 244/53 B |
| 5,045,004 | 9/1991 | Kim | 114/337 |

OTHER PUBLICATIONS

NACA Experimental Investigation of NtCA Submerged Duct Entrances Oct. 1945.

*Primary Examiner*—Edwin L. Swinehart
*Attorney, Agent, or Firm*—Michael J. McGowan; Michael F. Oglo; Prithvi C. Lall

[57] ABSTRACT

There is presented an underwater body and intake scoop, the underwater body having a wall defining a major portion of the body, the wall being exposed to water during movement of the body through a water environment. The intake scoop includes a recess in the wall of the body, the recess having forward and aft edges extending substantially width-wise of the body and interconnected by generally length-wise extending side edges to form, in plan view, a multi-sided recess with the side and aft edges being rounded to facilitate reduction of turbulence and cavitation. A bottom surface of the recess slopes from the forward edge inwardly of the wall. The recess is in communication with a conduit extending to the interior of the body.

7 Claims, 2 Drawing Sheets

UNDERWATER BODY AND INTAKE SCOOP

STATEMENT OF GOVERNMENT INTEREST

The invention described herein may be manufactured and used by or for the Government of the United States of America for governmental purposes without payment of any royalties thereon or therefor.

BACKGROUND OF THE INVENTION (1) Field of the Invention

This invention relates to underwater bodies and scoops fixed therein for ingesting water as the body moves through a water environment, and is directed more particularly to such a scoop which limits hydrodynamic cavitation and, thereby, the consequences thereof.

(2) Description of the Prior Art

Three types of water inlets are used in underwater bodies such as torpedoes, unmanned underwater vehicles, submarines, and the underwater hull portions of surface vessels: (1) ports flush with the surface of the body, (2) protruding scoops, and (3) recessed scoops, that is, scoops extending underneath the outer surface of the body.

Flush ports are not effective for many applications, due primarily to the lack of notable dynamic pressure head. Protruding scoops, while generally effective with respect to inlet flow volume and pressure head, are undesirable in many applications because of drag created by the protrusion beyond the exterior of the body and because of excess cavitation generated thereby. Recessed scoops represent a compromise between flush ports and protruding scoops. Recessed scoops provide better pressure head and intake volume than do flush ports, and better cavitation performance than protruding scoops, but, conversely, suffer less pressure head and intake volume than protruding scoops and more cavitation than is present in flush ports. Consequently, there is a need for a recessed scoop wherein pressure head and intake volume are maximized and cavitation is minimized.

One of the situations in which cavitation presents a significant problem is the operation of an underwater vehicle at the shallower depths of the littoral regions of the ocean. Underwater vehicles operate in these regions for among other reasons, anti-mine naval missions.

Cavitation causes the undesired effects of hydrodynamic drag, noise vibration, and enhancement of corrosion and pitting due to impulse effects of cavitation behavior at the boundary between the water and the hull of a body in motion.

SUMMARY OF THE INVENTION

An object of the invention is, therefore, to provide a recessed scoop in an underwater body, which scoop limits cavitation so as to prevent the effects thereof.

A further object of the invention is to provide such a scoop having acceptable intake volumes under acceptable pressures.

A still further objects of the invention is to provide such a scoop which is of special utility for underwater vehicles engaged in naval missions in the shallower littoral regions of the ocean.

With the above and other objects in view, as will hereinafter appear, a feature of the present invention is the provision of an underwater body and intake scoop, the underwater body having a wall defining a major portion of the body, the wall being exposed to water during movement of the body through a water environment. The intake scoop includes a recess in the wall of the body, the recess having forward and aft edges extending substantially width-wise of the body and interconnected by generally length-wise extending side edges to form, in plan view, a multi-sided recess with the side and aft edges being rounded. A bottom surface of the recess slopes from the forward edge inwardly of the wall. The recess is in communication with a conduit extending to the interior of the body.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
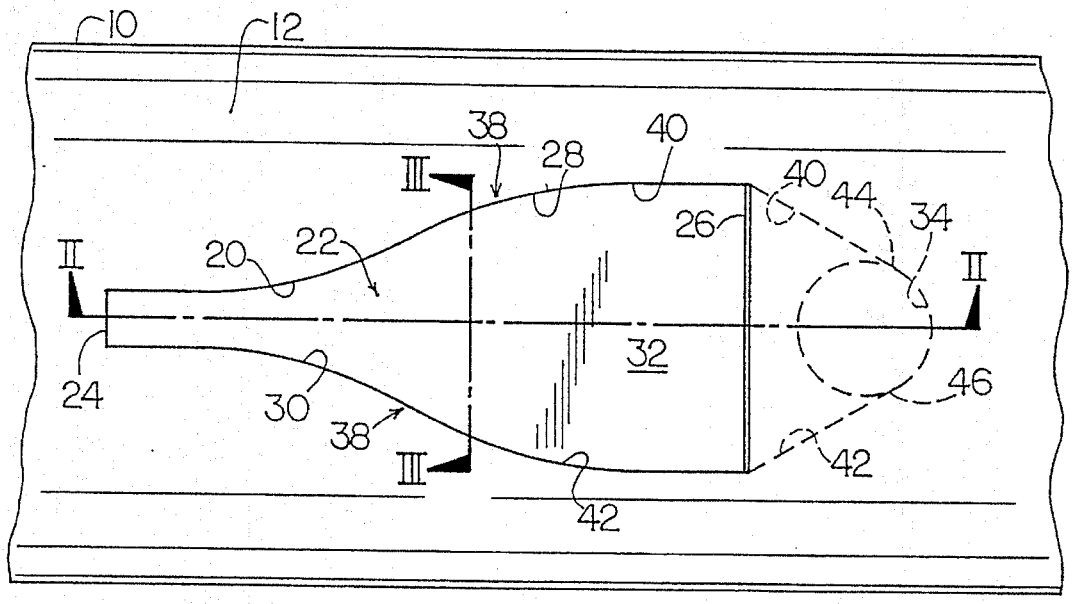
FIG. 1 is a top plan view of a portion of an underwater body and one form of an intake scoop illustrative of an embodiment of the invention.
Figure 2:
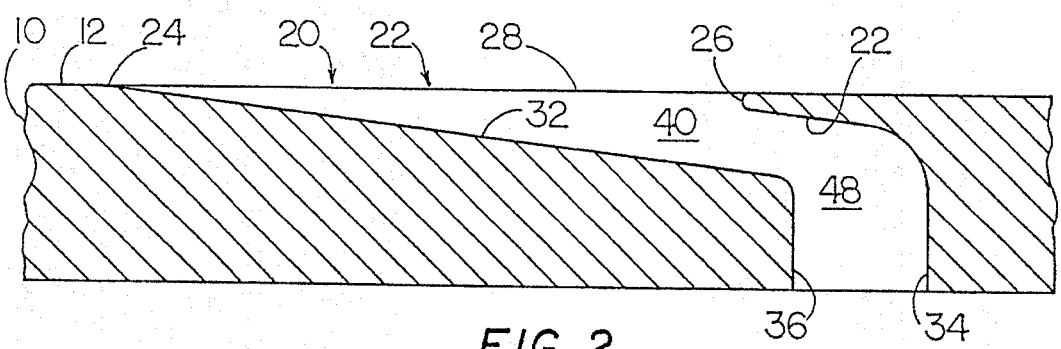
FIG. 2 is a sectional view taken along line II—II of FIG. 1.
Figure 3:
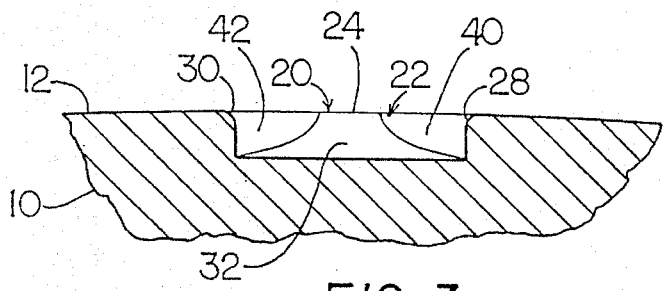
FIG. 3 is a sectional view taken along line III—III of FIG. 1.

Referring to FIGS. 1–3, it will be seen that an illustrative underwater body and intake scoop comprises a body 10, which may be a complete hull, as in the case of elongated, axisymetrical torpedoes, unmanned underwater vehicles other than torpedoes, and submarines, or may be an underwater portion of a surface vessel with the major axis of the intake scoop parallel to that of the vessel. Body 10 is provided with a wall 12 which defines a major portion of the body (or in the case of a surface vessel of its underwater portion). The wall 12 is exposed to water during movement of the body through a water environment.

As shown in FIG. 1 the intake scoop 20 comprises a longitudinally aligned, multisided recess 22 which is formed in wall 12 of body 10. Recess 22 is bounded by: (i) a forwardmost (i.e., in direction of the motion of body 10), at least generally transverse, line of demarcation 24 between the outer surface of the body and a sloping bottom surface of the recess (which will be described); an at least generally transverse forwardmost loci 26 of a forwardly projecting ledge portion of wall 12; and a pair of confronting, at least generally longitudinally extending, sides 28, 30, which interconnect demarcation line 24 and loci 26. Recess 22 is elongated with bilateral symmetry about its major axis, which is co-parallel with the longitudinal axis of body 10.

In accordance with the present invention an important structural feature of this recess 22 is the cross section of its sides, and for convenience in describing these cross sections the bounds of recess 22 may hereinafter and in the claims be referred to as "edges". Thus "demarcation line 24" may be referred to as—forward edge 24—; "transverse loci 26" as—aft edge 26—; and "confronting sides 28, 30" as—side edges 28, 30—.

As shown in FIGS. 2 and 3, the side and aft edges 28, 30, 26 are rounded to reduce and limit cavitation as body 10 moves through the water. It has been found that in torpedoes the most effective radii for rounded edges 28, 30, 26, include 1/32 inch, 1/16 inch, 1/8 inch and 1/4 inch.

The recess 22 further is provided with a bottom surface 32 sloping from forward edge 24 inwardly of body wall 12. The recess 22 is in communication with a conduit 34 extending to the interior 36 of body 10.

Figure 4:
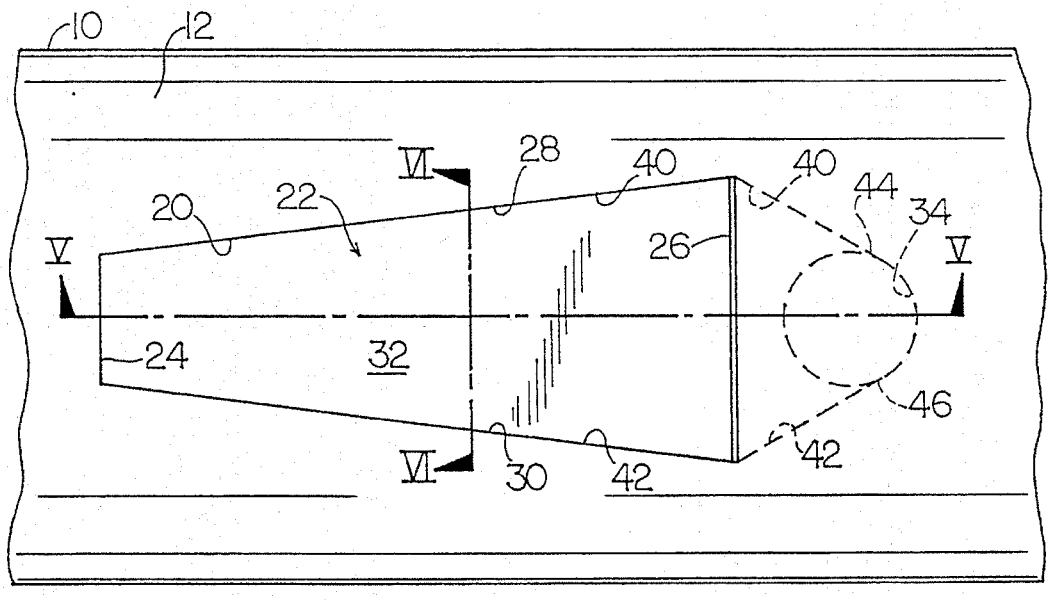
FIG. 4 is a top plan view of a portion of an underwater body and another form of intake scoop illustrative of an alternative embodiment of the invention.

As shown in FIG. 1, side edges 28, 30 diverge from each other from forward (left in FIG. 1) to aft (right in FIG. 1) of body 10. The side edges 28, 30 may be curved, as shown in FIG. 1, or may be straight, as shown in FIG. 4. In the embodiment shown in FIG. 1, portions 38 of side edges 28, 30 are shaped as bilaterally symmetrical curves diverging from one another in the aft direction, about the major axis of recess 22. In the alternative embodiment shown in FIG. 4, side edges 28, 30 are straight and the recess 22, in plan view, is of polygonal configuration. Aside from the difference in recess configurations, the embodiments of FIGS. 1 and 4 are similar. While a four-sided recess is illustrated in FIG. 4, it will be apparent that the polygonal configuration could include six or more side edges.

Figure 5:
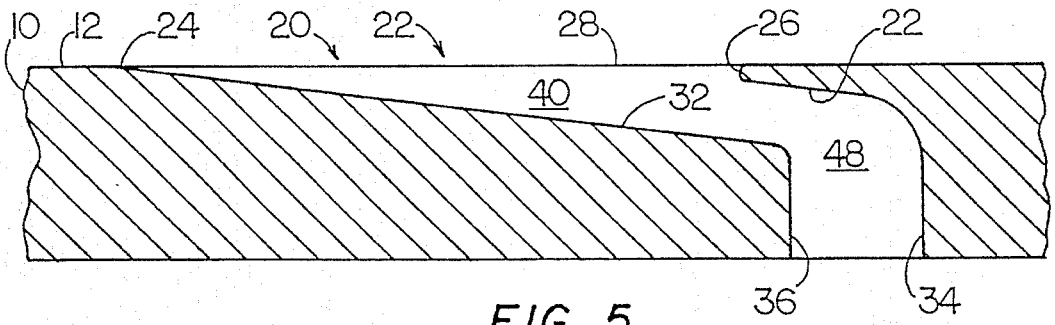
FIG. 5 is a sectional view taken along line V—V of FIG. 4.
Figure 6:
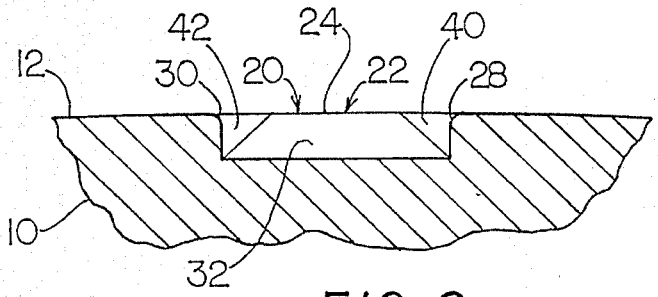
FIG. 6 is a sectional view taken along line VI—VI of FIG. 4.

Referring to FIGS. 2 and 5, it will be seen that recess 22 extends aft beyond and beneath aft edge 26 to intersect conduit, 34 which is disposed aft of aft edge 26. The recess 22 includes side walls 40, 42 which diverge in accordance with the divergence of side edges 28, 30 until reaching aft edge 26, at which point side walls 40, 42 converge to points of tangency 44, 46 on conduit 34. Conduit 34 preferably is round, as shown in FIGS. 1 and 4, but may be of an oval cross-sectional configuration (not shown). The bottom surface 32 of recess 22 continues its slope beyond aft edge 26, to intersect conduit 34.

The sloping configuration of bottom surface 32 and the diverging side walls 40, 42, in conjunction with the rounded edges 26, 28, 30 facilitate high-volume entry of water with reduced turbulence and cavitation. The convergence of side walls 40, 42 just forward of the conduit 34 (extending essentially to aft edge 26 in the embodiments of FIGS. 1 and 4) provides pressure head at the entrance 48 of conduit 34.

There is thus provided a recessed scoop effective to ingest high volumes of water at sufficient pressures and effective to limit hydrodynamic cavitation so as to significantly reduce the undesirable effects thereof discussed in the earlier Description of the Prior Art section hereof.

It is to be understood that the present invention is by no means limited to the particular constructions herein disclosed and/or shown in the drawings, but also comprises any modifications or equivalents within the scope of the claims.

What is claimed is:

1. In combination, an underwater body and an intake scoop, said underwater body having a wall defining a major portion of said body, said wall being exposed to water during movement of said body through a water environment;

said intake scoop comprising a recess in said wall of said body, said recess having forward and aft edges extending substantially width-wise of said body and interconnected by generally length-wise extending side edges to form, in plan view, a multi-sided recess, said side and aft edges being rounded, a bottom surface of said recess sloping from said forward edge inwardly of said body;

said underwater body having interior portions forming a conduit of rounded cross-section and extending inwardly of said body, said recess being in communication with said conduit; and said recess having side walls diverging from each other between said forward and aft edges to provide for high-volume entry of water and extending aft beyond and beneath said aft edge, and converging aft of said edge to points of tangency of said conduit, whereby to provide pressure head at an entrance to said conduit.

2. The invention in accordance with claim 1 wherein said side edges are curved, in plan view, and at least through a portion thereof curve outwardly from each other.

3. The invention in accordance with claim 1 wherein said side edges are straight and said multi-sided recess is a polygon.

4. The invention in accordance with claim 1 wherein said bottom surface of said recess continues said sloping aft of said aft edge and intersects said conduit.

5. The invention in accordance with claim 4 wherein said body is a torpedo hull and said rounded edges are provided with radii of 1/32–1/4 inch.

6. The invention in accordance with claim 5 wherein each of said rounded edges is of a radius selected from a group consisting of 1/32 inch, 1/16 inch, 1/8 inch and 1/4 inch.

7. The invention in accordance with claim 1 wherein said body is of metal and said rounded edges are effective to limit hydrodynamic cavitation to prevent corrosion and pitting of said body and damage to said body by impulse effects of cavitation behavior at the boundary between the body and the water.

* * * * *